US006835129B1

(12) United States Patent
Harris

(10) Patent No.: US 6,835,129 B1
(45) Date of Patent: Dec. 28, 2004

(54) HEATING, VENTILATION, AND AIR-CONDITIONING DUCT BOOT SEAL

(75) Inventor: Danny R. Harris, Lakeport, CA (US)

(73) Assignee: Posi-Seal, Inc., Newark, CA (US)

( * ) Notice: Subject to any disclaimer, the term of this patent is extended or adjusted under 35 U.S.C. 154(b) by 0 days.

(21) Appl. No.: 10/340,184

(22) Filed: Jan. 9, 2003

Related U.S. Application Data

(60) Provisional application No. 60/347,387, filed on Jan. 9, 2002.

(51) Int. Cl.[7] ..... F24F 7/00

(52) U.S. Cl. ..... 454/370; 454/289

(58) Field of Search ..... 454/289, 370; 49/463, 464; 160/106

(56) References Cited

U.S. PATENT DOCUMENTS 2,834,278 A * 5/1958 Crute, Jr. ..... 454/276
3,130,659 A * 4/1964 Compton et al. ..... 454/276
4,026,082 A * 5/1977 Crofoot ..... 52/302.7
4,502,368 A * 3/1985 Hempel ..... 454/277
4,712,343 A 12/1987 Dearing et al.
4,829,886 A 5/1989 Battaglin
5,100,445 A * 3/1992 Johnson et al. ..... 55/413
5,180,331 A 1/1993 Daw et al.
5,213,543 A * 5/1993 Clarino ..... 454/292
5,479,984 A * 1/1996 Easterbrook et al. ..... 165/96
5,954,221 A * 9/1999 Boland ..... 220/495.08
6,461,235 B2 10/2002 Rutler et al.
6,558,248 B1 * 5/2003 Moore et al. ..... 454/289
6,575,827 B1 * 6/2003 Rutler et al. ..... 454/289

* cited by examiner

*Primary Examiner*—Jiping Lu
(74) *Attorney, Agent, or Firm*—Larry D. Johnson; Craig M. Stainbrook; Johnson & Stainbrook, LLP

(57) ABSTRACT

An HVAC duct boot seal is disclosed which may be installed on vent openings during construction and prior to protect the ventilation system from contamination by construction debris entering the vent openings and to improve the vent seal after construction is complete. The boot seal includes a selectively removable cover portion, at least one side wall disposed at a substantially right angle to the cover portion and defining a recess for engagement with the edge of a duct boot opening, and a flange disposed outwardly from the exterior surface of the side wall. Also disclosed is a method of using the inventive duct boot seal.

11 Claims, 6 Drawing Sheets

HEATING, VENTILATION, AND AIR-CONDITIONING DUCT BOOT SEAL

CROSS REFERENCE TO RELATED APPLICATIONS

This application claims the benefit of Provisional Application No. 60/347,387, filed Jan. 9, 2002.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to duct work for interior ventilation systems, and more particularly to a heating, ventilation, and air-conditioning air supply and return duct boot seal.

BACKGROUND INFORMATION AND DISCUSSION OF RELATED ART

In structures generally, the typical heating, ventilation, and air-conditioning (HVAC) system includes a constellation of supply air ducts and return air ducts servicing a defined area. In residential construction the system ducts are designed to fit between the joists and studs of framing members and terminate in supply outlets and returns. The warm air supply outlets are typically located low in the floor near exterior walls or on low on exterior walls. Returns are generally placed above the occupied spaces, either high in the inside walls or in the ceilings of the occupied spaces. Most ducts are terminated by a sheet metal duct boot interposed between floor or ceiling joists. The duct boot almost invariably provides an imperfect seal and thus allows supply air to escape from the duct outside the conditioned air space.

It is customary in construction practice to install HVAC systems before or after framing and the installation of doors, windows, and wall and roof coverings, but prior to finishing interior walls, ceilings, floors, and interior trim. Vent grilles or other ornamental and functional covers placed on vent openings are usually one of the last items on a construction punch list, installed when the structure is effectively ready for occupancy. Thus, during the final stages of construction the air supply and return air ducts are generally left uncovered and are therefore vulnerable to contamination from debris, dust, scrap material, water, and various other contaminants in the construction zone. Furthermore, exposed vents pose an injury risk to workers on the site.

Accordingly, it would be desirable to have means to temporarily cover HVAC duct boots during construction. It would further be desirable to provide an improved seal at the vent opening. Ideally, in the interests of economy, it would be desirable to provide an HVAC duct boot cover that serves both purposes and may be installed during construction prior to interior finishing, which does not require complete removal before installation of vent grilles, and which improves the air seal at the vent opening. The present invention addresses the foregoing objects.

A few devices in the prior art are known to provide vent boot covers, including U.S. Pat. No. 4,712,343, to Dearing et al, which teaches a re-usable shield for temporarily covering and protecting interior vent openings in residential and commercial HVAC systems. The device includes a rectangular plate attached to or formed with a smaller rectangular block which are each sized and grooved to allow the shield to be universally used in all standard size floor and baseboard vent openings.

The device shown in Dearing must be removed in its entirety prior to installation of a floor or wall covering, and before use of the duct system by occupants. Thus it does not provide protection of the vent opening during finish operations, nor does it improve the vent opening seal during use.

U.S. Pat. No. 4,829,886, to Battaglin, which discloses a guard for insertion into a central heating duct system inlet or outlet. The device includes a top and bottom having disposed within the top thereof and extending towards the bottom thereof at least one recess, the recess having side walls extending from proximate the top to proximate the bottom of the guard mechanism, the side walls abutting at least one lateral flange proximate the top of the guard mechanism, each lateral flange extending laterally away from the recess proximate the top of the guard mechanism. Some of the side walls have a channel apparatus extending from the bottom of the guard mechanism to proximate the top of the guard mechanism and there at each channel continuing along the extension of a complimentary adjoining laterally extending flange whereat the channel terminates remote the recess. When the guard mechanism is inserted within an inlet or outlet of a ducting system, contaminants will be prevented from entering said system, but the circulation of air will be allowed through the channel apparatus disposed within the side walls and flanges of the guard mechanism. The mechanism is not removed after construction is complete.

The apparatus disclosed in Battaglin fundamentally alters the movement of air through the duct boot. Even if the channels are sufficiently large, air must pass around the recess, and therefore will exit or enter the vent only around the edges of the vent opening.

U.S. Pat. No. 5,180,331, to Daw et al, shows a device attachable to a suspended floor member for collecting materials which fall through grid openings in the floor member and for controlling the rate of airflow through the grid openings in an adjustable manner. The device includes a spill container for positioning under the grid openings of the floor member in a coordinated position such that a venting path is provided for permitting airflow past the spill container from above the floor member while retaining the capacity to collect liquids and particulate matter flowing through the grid openings. Adjustable dampening structure is coupled with the spill member to provide selection of differing vent openings to control rate of airflow through the structure.

The device shown in Daw et al is complex and involves numerous component parts. It is impracticable for use only as a protective cover during construction.

U.S. Pat. No. 6,461,235 to Rutler et al, discloses a temporary vent opening cover that may be secured over a vent opening during building construction to prevent debris from entering the vent opening and accumulating in the system duct work. The cover includes a generally flat cover plate sized and shaped to cover the vent opening and spaced outwardly from the surface when the vent opening cover is secured over the vent opening. Air passages allow air to flow past the cover plate between the duct work and the workspace. A layer of air filter material covers the air passages and prevents debris from passing through.

As with Dearing et al and Daw et al, the device shown in Rutler requires removal prior to use of the venting system by final building occupants.

None of the foregoing patents discloses, teaches, or suggests a single-piece temporary vent boot cover that is removable, in part, prior to use, but which provides an improved vent seal after finish construction is complete.

SUMMARY OF THE INVENTION

The HVAC duct boot seal of the present invention comprises***

***

DETAILED DESCRIPTION OF THE PREFERRED EMBODIMENTS OF THE INVENTION

Figure 1:
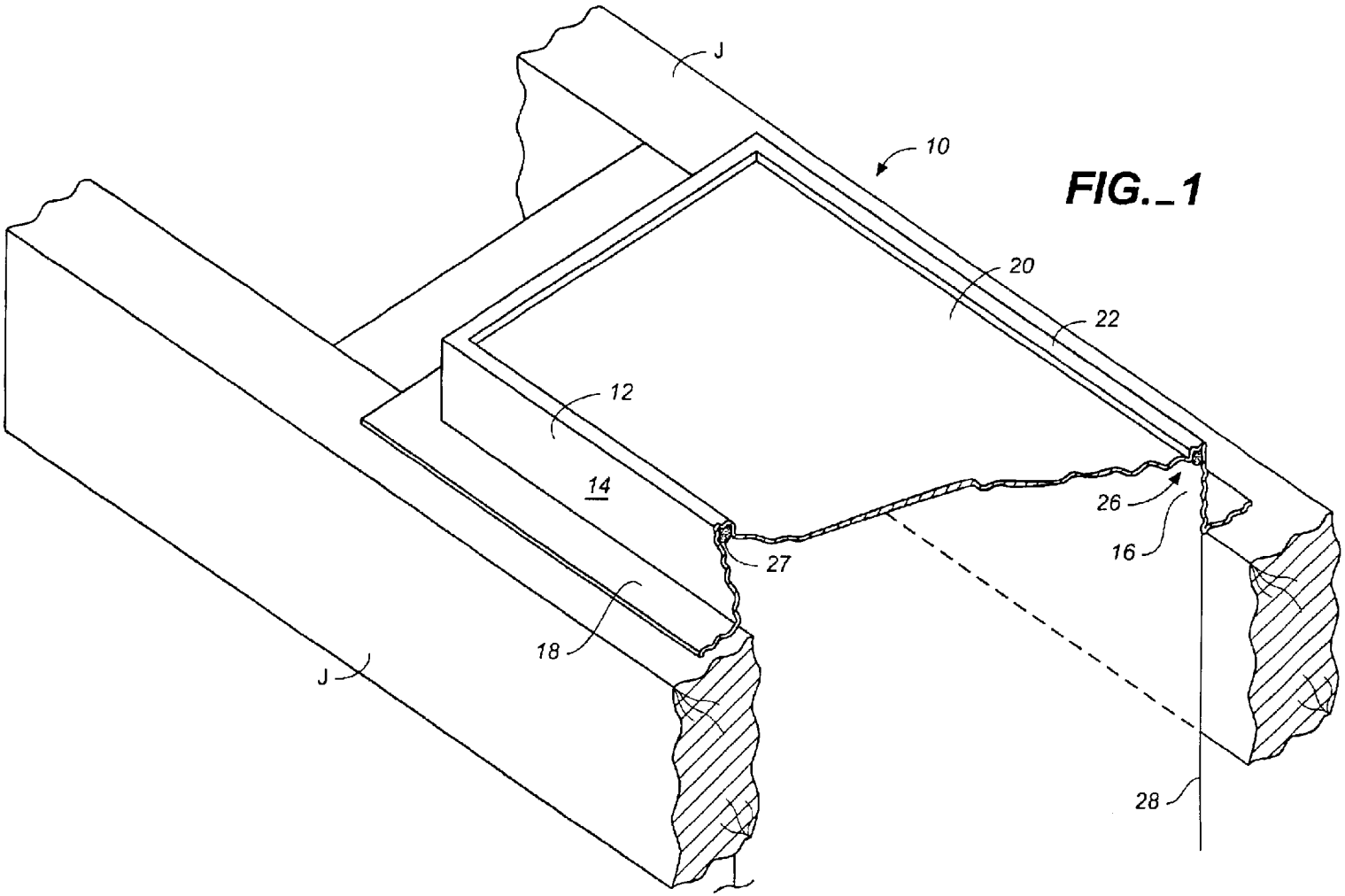
FIG. 1 is a partial cross-sectional perspective view of a first preferred embodiment of the HVAC duct boot seal of the present invention.
Figure 2:
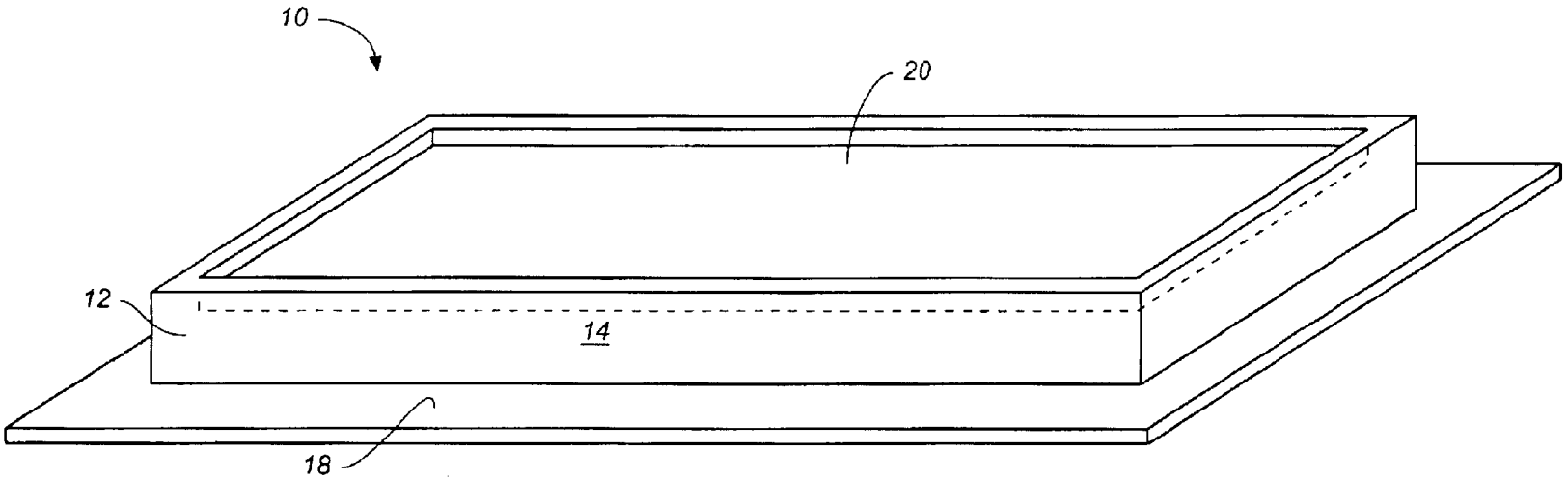
FIG. 2 is a perspective view of the apparatus of FIG. 1.
Figure 3:
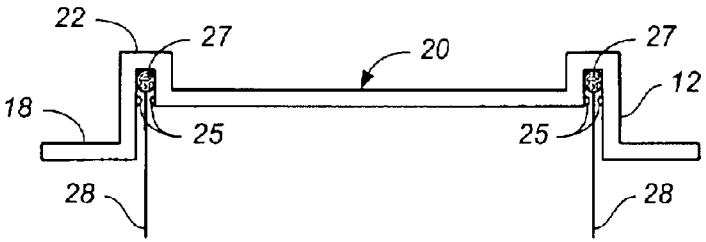
FIG. 3 is a cross-sectional end view in elevation of the apparatus of FIGS. 1 and 2.
Figure 4:
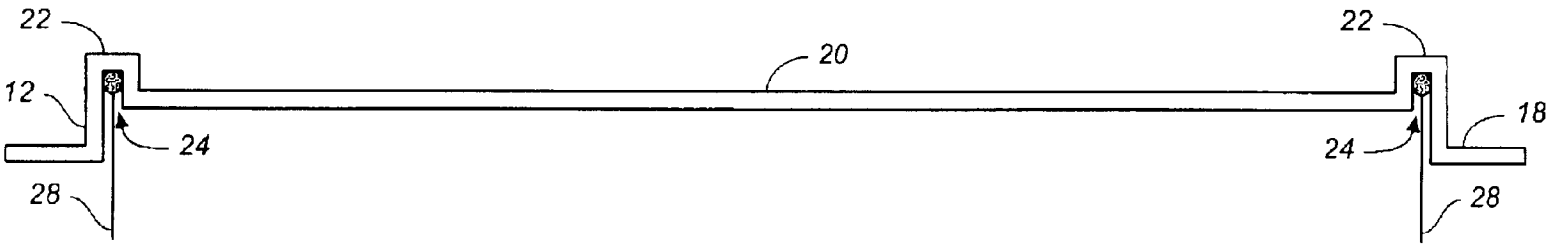
FIG. 4 is a cross-sectional side view in elevation of the apparatus of FIGS. 1–3.

Referring to FIGS. 1 through 8, wherein like reference numerals refer to like components in the various views, FIG. 1 is a partial cross-sectional perspective view of a first preferred embodiment of the HVAC duct boot seal of the present invention, and FIGS. 2, 3, and 4 are, respectively, a perspective view, a cross-sectional end view in elevation, and a cross-sectional side view in elevation, thereof. These views collectively show that the inventive apparatus, generally denominated 10, comprises a seal in the fashion of a cover, lid, or cap, said seal being preferably fabricated of a flexible material, e.g., thermosetting resins, thermoplastic resins, synthetic rubber, synthetic fibers, and acrylic plastics, which may be easily and economically molded or sprayed in production. Preferred materials include polyethylene and ABS, though sheet metal may also be used in a duct boot seal having a central "knockout" portion. For use in most environments, the seal is substantially rectangular in shape, as most vents are similarly shaped in cross section. However, as may be readily appreciated, the actual shape of the inventive seal is not critical to its function and may take any of a number of suitable shapes, each designed to fit the duct boot to which it will be applied.

The duct boot seal 10 of the present invention includes at least one side wall 12, though more commonly the seal would include a plurality of vertical side walls 12. For example, if the duct boot seal were substantially round or oval in shape, then only one side wall would be included. However, in most instances the geometry of the duct boot will be substantially rectangular or square, to match the most common cross-sectional geometry of HVAC ducts, and thus four side walls are included. The side walls have exterior surfaces 14 and interior surfaces 16 and are disposed upwardly from a flange or fin 18 projecting outwardly from and substantially at right angles to the exterior surfaces of the side walls. The flange is preferably continuous around the perimeter of the side walls to provide the optimum seal, though it need not be to be structurally reliable.

Spanning the interior region defined by the interior surfaces of the side walls is a cover portion 20, which extends to a rim 22 defining an interior recess or channel 24 adapted for securely clamping the duct boot seal on the upper edge 26 of the sheet metal walls of a vent duct boot 28. Sealing material 27 such as caulking or other sponge-like material (such as weather stripping) may be introduced into the channel to provide a more airtight seal. Alternatively, channel 24 may include one or more lower expansions 25 (see FIG. 3), preferably opposing expansions disposed on each interior side of the channel, so that the entire duct boot seal can snap fit over the upper edge 26 of the vent duct boot to form a positive seal, such as that provided by the lid and container combinations of the well-known RUBBERMAID® and TUPPERWARE® food storage products.

Of note, FIGS. 1–4 show the apparatus as designed for use in new construction. In this application, the inventive vent cover is secured directly to framing members, such as floor joists J, and prior to installation of a subfloor or drywall, whereas when used as a retrofit device in a finished structure, the cover is installed over the subfloor and under the floor covering. In either case, the cover portion may be removed, either by cutting it out (in the case of a seal fabricated from thermosetting resins, thermoplastic resins, synthetic rubber, synthetic fibers, and acrylic plastics), or knocked out (in the case of a seal fabricated from metal and provided with scores to define a knockout area).

Figure 5:
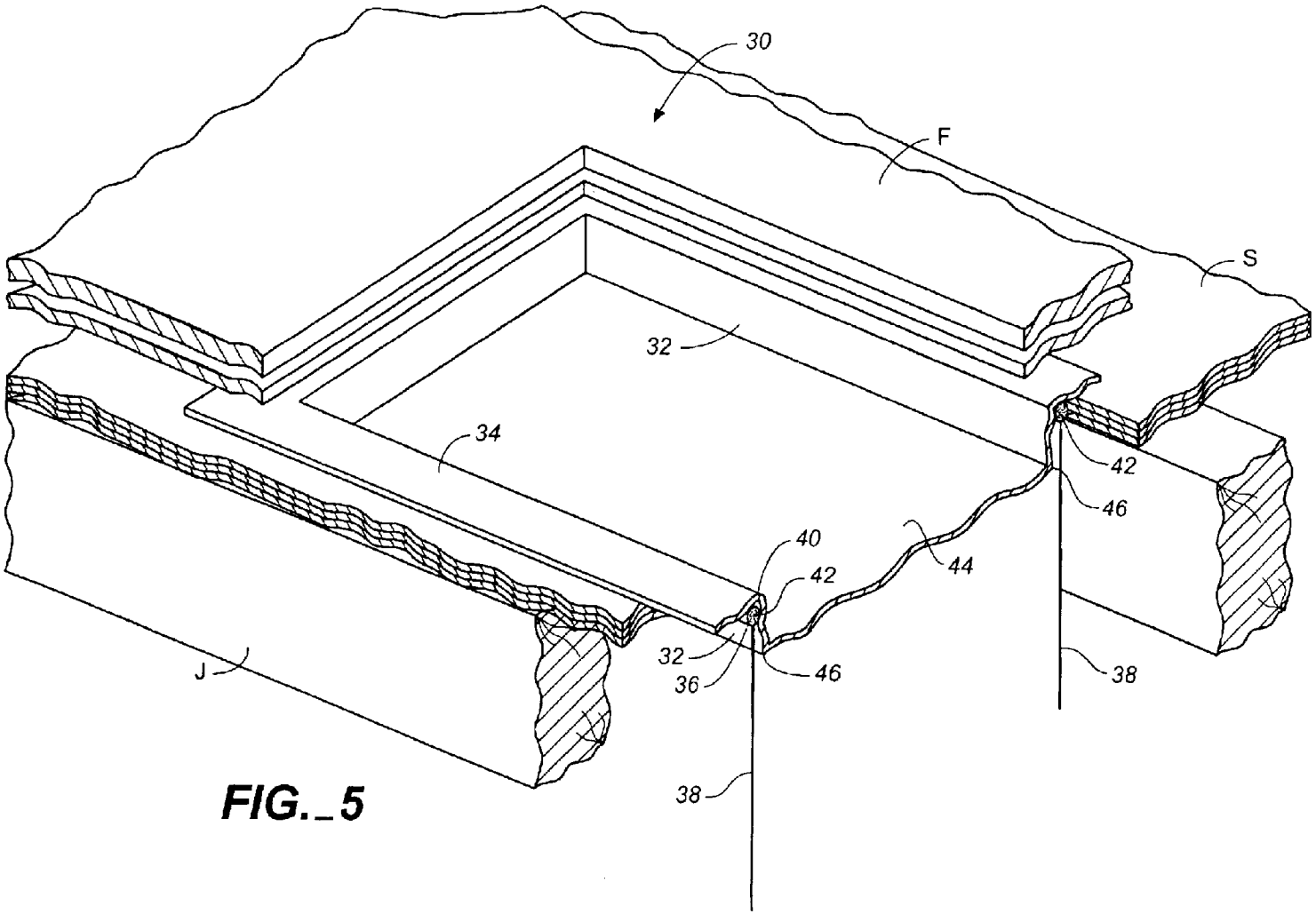
FIG. 5 is a partial cross-sectional perspective view of a second preferred embodiment of the HVAC duct boot seal of the present invention, shown installed in a floor space between subfloor and a floor covering.
Figure 6:
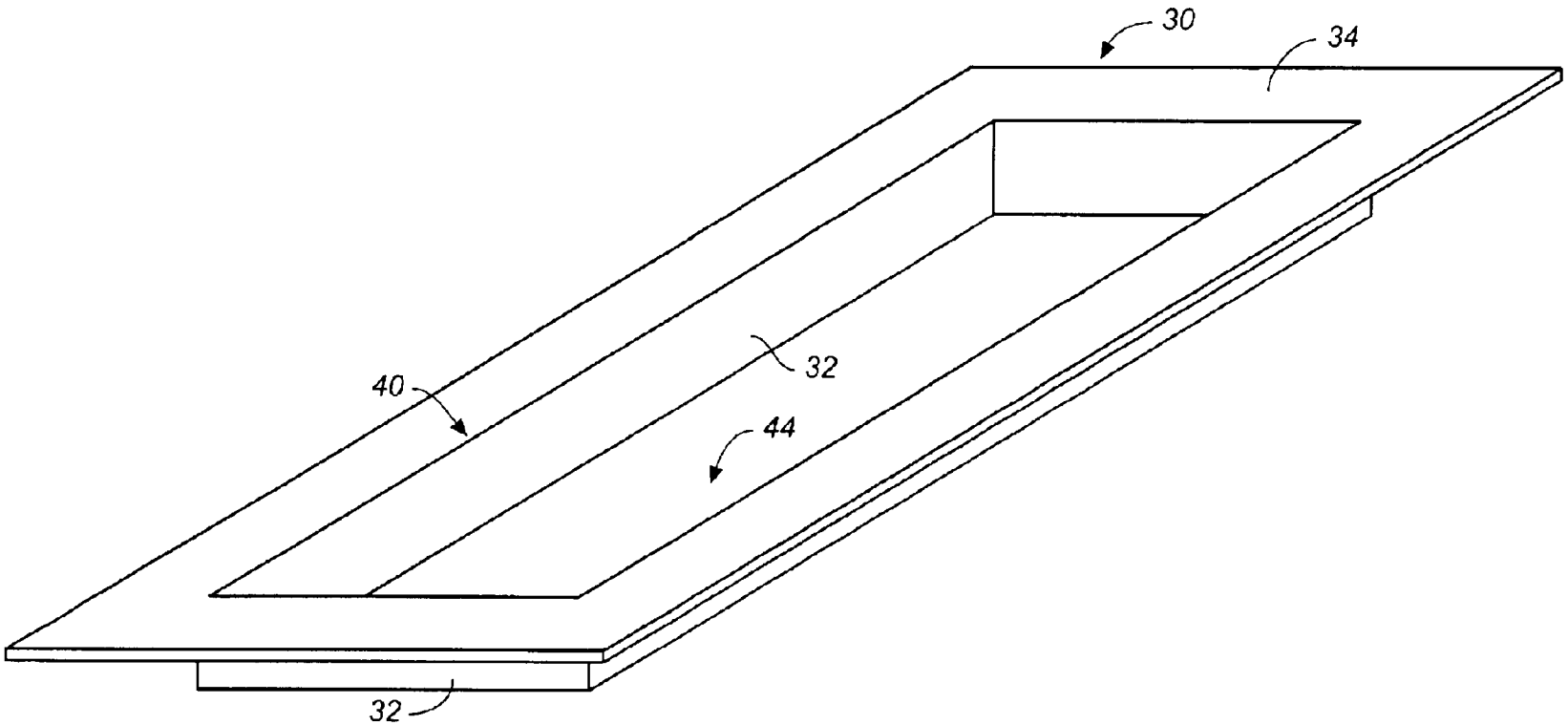
FIG. 6 is a perspective view of the apparatus of FIG. 5.
Figure 7:
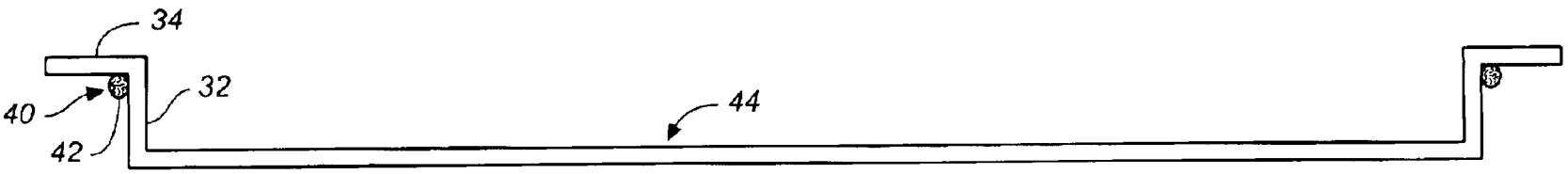
FIG. 7 is a cross-sectional side view in elevation of the apparatus of FIGS. 5 and 6.
Figure 8:
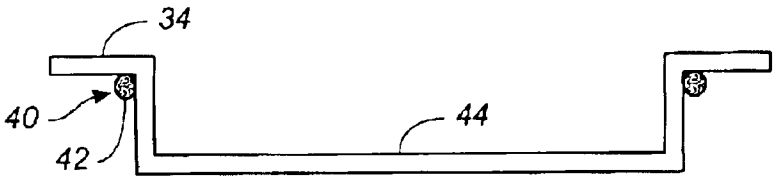
FIG. 8 is a cross-sectional end view in elevation of the apparatus of FIGS. 5–7.

FIG. 5 is a partial cross-sectional perspective view of a second preferred embodiment of the HVAC duct boot seal of the present invention, while FIG. 6 is a perspective view of the apparatus of FIG. 5, and FIG. 7 is a cross-sectional side view in elevation of the apparatus of FIGS. 5 and 6. FIG. 8 is a cross-sectional end view in elevation of the apparatus of FIGS. 5–7.

FIGS. 5–8 collectively show that the inventive apparatus may be adapted for use as a retrofit device in fully finished construction. In this embodiment 30 the vertical side walls 32 extend downwardly from the flange 34 and the upper edge 36 of the duct boot 38 is sealed in an upper recess or corner 40 defined by the sidewalls and the flange. Again, sealing material 42 may be employed to facilitate a secure seal. Stated differently, the side walls are disposed upwardly from the cover portion and terminate in a corner defined by the side walls and the flange, which extends outwardly from the side wall.

In the second preferred embodiment, the cover portion 44 spans the entire interior region defined by the lower edges 46 of the side walls.

Referring now to FIG. 5, installation of the inventive duct boot seal is a simple matter of positioning the flange over the next-to-last surface through which the duct boot terminates. For instance, in a floor the flange would rest immediately above plywood sub-flooring S, rather than immediately upon joists J. In a wall or ceiling, the duct boot cover is secured against the outside surface of sheet rock or plaster. Any finish material F, such as carpet padding and carpeting, tile, wood, or linoleum, may then be applied immediately over the flange 34 so that air leaks are effectively eliminated from the duct boot. Once installed, the cover portion is either cut out using a razor knife, or similarly sharp cutting tool, or knocked out if sheet metal is employed. The cover portion once removed is simply discarded. The air supply or return is then open for covering with a specified grill or other cover and is fully functional.

In its most essential aspect, the inventive apparatus may be characterized as an HVAC duct boot seal, comprising a selectively removable cover portion; at least one side wall disposed at a substantially right angle to said cover portion and defining a recess for engagement with the edge of a duct boot opening, said at least one side wall having interior and exterior surfaces; and a flange disposed outwardly from said exterior surface of said at least one side wall.

As noted, the duct boot seal of the present invention may be installed as a retrofit in existing systems or may be employed in new construction. In either case, the inventive apparatus provides an improved seal at the vent opening. In the latter case, the apparatus performs the additional function of keeping construction debris and worker litter from clogging or contaminating the duct system.

Accordingly, the HVAC duct boot seal of the present invention provides a method of temporarily covering a vent opening during construction while simultaneously providing a method of improving the vent opening seal at the completion of construction by removing all or a portion of the cover portion. The method steps include the following: (a) providing a duct boot seal having a selectively removable cover portion, at least one side wall disposed at a substantially right angle to the cover portion and defining a recess for engagement with the edge of the duct boot opening, the at least one side wall having interior and exterior surfaces, and a flange disposed outwardly from the at least one side wall and the cover portion; (b) fitting the duct boot seal over the edge of the duct boot opening so that the cover portion of the duct boot seal covers the duct boot opening during construction; and (c) removing a portion of the cover portion when construction is completed.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Accordingly, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which is measured by the claims only, nor is it intended to be limiting as to the scope of the invention in any way.

What is claimed is:

1. A method of temporarily scaling a duct boot opening having an edge to prevent debris from entering a duct system during construction, and of improving the seal of the duct boot opening when construction is finished, said method comprising the steps of:

(a) providing a duct boot seal having a selectively removable cover portion extending to and surrounded by a rim, at least one side wall disposed at a substantially right angle to the cover portion and integral with the rim to form a recess for engagement with the edge of a duct boot edge, wherein the recess includes opposing expansions that facilitate a snap fit of the seal over the duct boot edge, the at least one side wall having interior and exterior surfaces, and a flange disposed outwardly from the at exterior surface of the least one side wall;

(b) fitting the duct boot seal over the edge of the duct boot opening so that the cover portion of the duct boot seal covers the duct boot opening during construction; and (c) removing a portion of the cover portion when construction is completed.

2. The method of claim 1, further including the step of providing sealing material in the recess prior to said step (b).

3. An HVAC duct boot seal, comprising:

a selectively removable cover portion;

at least one side wall disposed at a substantially right angle to said cover portion and defining a recess for engagement with the edge of a duct boot opening, said at least one side wall having interior and exterior surfaces; and a flange disposed outwardly from said exterior surface of said at least one side wall;

wherein said selectively removable cover portion extends to and is surrounded by a rim integral with said at least one side wall, said at least one side and said rim forming said recess adapted for engaging said seal with the edge of a vent duct boot opening, and wherein said at least one side wall and said rim each include an expansion disposed in an opposing relationship in the recess.

4. The duct boot seal of claim 3, wherein said at least one side wall is disposed upwardly from said cover portion and terminates in a comes defined by said at least one side wall and said flange.

5. The duct boot seal of claim 3, wherein said duct boot seal is fabricated from material selected from the group consisting of thermosetting resins, thermoplastic resins, synthetic rubber, synthetic fibers, and acrylic plastics.

6. The duct boot seal of claim 3, wherein said duct boot seal is fabricated of metal and said cover portion is scored to define a knockout area.

7. The duct boot seal of claim 3, wherein said duct boot has four side walls.

8. An HVAC duct boot seal, comprising:

a selectively removable cover portion;

at least one side wall disposed at a substantially right angle to said cover portion and defining a recess for engagement with the edge of a duct boot opening, said at least one side wall having interior and exterior surfaces;

sealing material disposed in the recess; and a flange disposed outwardly from said exterior surface of said at least one side wall;

wherein said selectively removable cover portion extends to and is surrounded by a rim integral with said at least one side wall, said at least one side and said rim forming said recess adapted for engaging said seal with the edge of a vent duct boot opening.

9. A method of temporarily sealing a duct boot opening having an edge to prevent debris from entering a duct system during construction, and of improving the seal of the duct boot opening when construction is finished, said method comprising the steps of:

(a) providing a duct boot seal having a selectively removable cover portion, at least one side wall disposed at a substantially right angle to the cover portion and defining a recess for engagement with the edge of the duct boot opening, the at least one side wall having interior and exterior surfaces, and a flange disposed outwardly from the at least one side wall and the cover portion;

(b) providing sealing material in the recess to improve the seal over the duct boot edge;

(c) fitting the duct boot seal over the edge of the duct boot opening so that the cover portion of the duct boot seal covers the duct boot opening during construction; and (d) removing a portion of the cover portion when construction is completed.

10. The method of claim 9, wherein the seal is fabricated from material selected from the group consisting of thermosetting resins, thermoplastic resins, synthetic rubber, synthetic fibers, and acrylic plastics, and wherein said step (c) comprises cutting out the cover portion with a cutting tool.

11. The method of claim 9, wherein the seal is fabricated from metal and the cover portion includes scores defining a knockout area, and wherein said step (c) comprises knocking out the knockout area.

* * * * *